United States Patent [19]

Brown

[11] Patent Number: 4,967,646

[45] Date of Patent: Nov. 6, 1990

[54] PORTABLE FLOOR AIR DUCT

[75] Inventor: Frank P. Brown, North York, Canada

[73] Assignee: Ward-Brown Industries Ltd., Markham, Canada

[21] Appl. No.: 361,235

[22] Filed: Jun. 5, 1989

[51] Int. Cl.[5] ..... F24F 13/06

[52] U.S. Cl. ..... 98/40.19; 98/103

[58] Field of Search ..... 98/40.19, 101, 103, 98/105, 108, 109, 114, DIG. 7; 422/124

[56] References Cited

U.S. PATENT DOCUMENTS

| | | | |
|---|---|---|---|
| 3,308,746 | 3/1967 | Weiss | 98/114 X |
| 3,359,883 | 12/1967 | Murphy | 98/40.19 |
| 4,020,753 | 5/1977 | Efstratis | 98/40.19 |
| 4,102,656 | 7/1978 | Kuritz | 422/124 X |
| 4,481,871 | 11/1984 | Efstratis | 98/40.19 |
| 4,850,266 | 7/1989 | Bennett | 98/40.19 |

FOREIGN PATENT DOCUMENTS

| | | | |
|---|---|---|---|
| 497471 | 9/1954 | Italy | 98/40.19 |

*Primary Examiner*—Harold Joyce
*Attorney, Agent, or Firm*—Thomas A. O'Rourke

[57] ABSTRACT

An air deflector for delecting air exiting from a residential floor vent to a location remote therefrom, comprising a first element having an inverted u-shaped cross section formed by a central wall panel and a pair of side walls depending from opposite longitudinal edges thereof, an end wall panel depending from the central wall panel and joining the side walls to form an inlet end, a second element having an inverted u-shaped cross section formed from a central wall and a pair of side walls depending from opposite longitudinal edges thereof, the second element being dimensioned telescopingly to engage with the first element with the central wall panels in abutment so that one end of second element extends beyond the first element to form an outlet end, the first and second elements being dimensioned so that when telescopingly engaged, the side and end walls of the first element and the side walls of the second element have substantially coplanar distal edges extending along the length thereof to lie against a floor surface surrounding the floor vent, the first element having a width sufficient to permit the inlet end to be aligned with the floor vent, the first and second elements in their telescoping arrangment together with the floor surface forming a duct through which air may be transferred from the vent along a duct to the outlet end.

6 Claims, 4 Drawing Sheets

PORTABLE FLOOR AIR DUCT

The present invention relates to residential heat vents and more particularly to deflectors for use with such vents.

It is common in forced air residential heating systems to distribute air throughout the residence by placing one or more heat vents in each room, their number and locations depending on the locations of windows, room size and shape. These vents are also typically placed in locations where they will not be blocked by furniture, drapes or other obstacles. Although every attempt is made to predict the most appropriate obstacle free locations in a room, it is typical to have at least one vent blocked by something. In the case of a curtain draped over the vent there are deflectors which deflect the exiting conditioned air away from the curtain. One such deflector is illustrated in U.S. Pat. No. 3,225,679 to Meyer.

Another type of deflector is that illustrated in U.S. Pat. No. 4,020,753 to Efstratis, which is for use in connection with wall mounted air vents to deflect air around furniture and the like. This deflector has two telescoping members one of which has an inlet in one side wall to engage the air vent and the other has an outlet in the opposite side wall for the exiting air. Efstratis suggests that the wall opposite the outlet be inclined toward the outlet and that a number of vanes be disposed in the outlet with the second vane projecting farther into the channel defined by the telescoping members so that it will interrupt the flow of air in a manner that will cause the air to flow evenly through the spaces between the vanes in the outlet.

However, these conventional deflectors are unsuitable as an inexpensive and simple measure to deflect air exiting from a vent which is blocked by a piece of furniture, such as a chesterfield, or some other obstacle.

It is therefore an object of the present invention to provide a novel heat vent extension device.

Briefly stated, the invention involves an air deflector for deflecting air exiting from a residential air vent to a location remote therefrom, comprising:

a first element having an inverted u-shaped cross section formed by a central wall panel and a pair of side walls depending from opposite longitudinal edges thereof; an end wall panel depending from the central wall panel and joining the side walls to form an inlet end;

a second element having an inverted u-shaped cross section formed from a central wall and a pair of side walls depending from opposite longitudinal edges thereof, the second element being dimensioned telescopingly to engage with the first element with the central wall panels in abutment so that one end of second element extends beyond the first element to form an outlet end;

the first and second elements being dimensioned so that when telescopingly engaged, the side and end walls of the first element and the side walls of the second element have substantially coplanar distal edges extending along the length thereof to lie against a floor surface surrounding the floor vent;

the first element having a width sufficient to permit the inlet end to be aligned with the floor vent, the first and second elements in their telescoping arrangement together with the floor surface forming a duct through which air may be transferred from the vent along a duct to the outlet end.

A preferred embodiment of the present invention is illustrated in the appended drawings in which.

Figure 1:
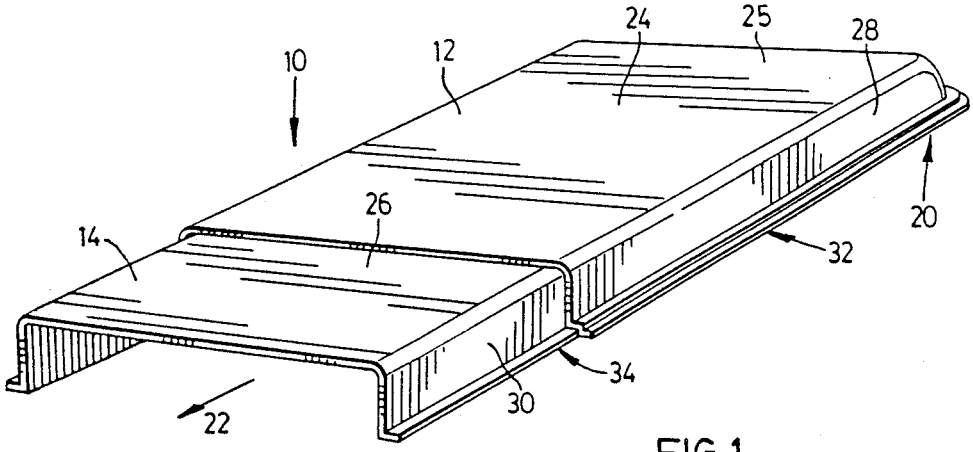
FIG. 1 is a perspective view of a heat vent deflector.

Referring to FIGS. 1 to 6, there is provided a heat vent deflector 10 having a first element 12 telescopingly engaged with a second element 14. The first element 12 has a width to match the length of a common floor vent shown at 16. The deflector 10 has an inlet end 20 to engage the vent 16, an outlet end 22. The distance between the inlet end and the outlet end is adjustable by relative displacement of elements 12, 14 to accommodate the location of an obstacle above the vent. In this manner, the deflector 10, when placed over the floor vent 16, causes air exiting the vent 16 to pass along a duct defined by the telescopingly engaged first and second 12 and 14 elements and the floor surface to the outlet end where the air is directed to the room.

Figure 2:
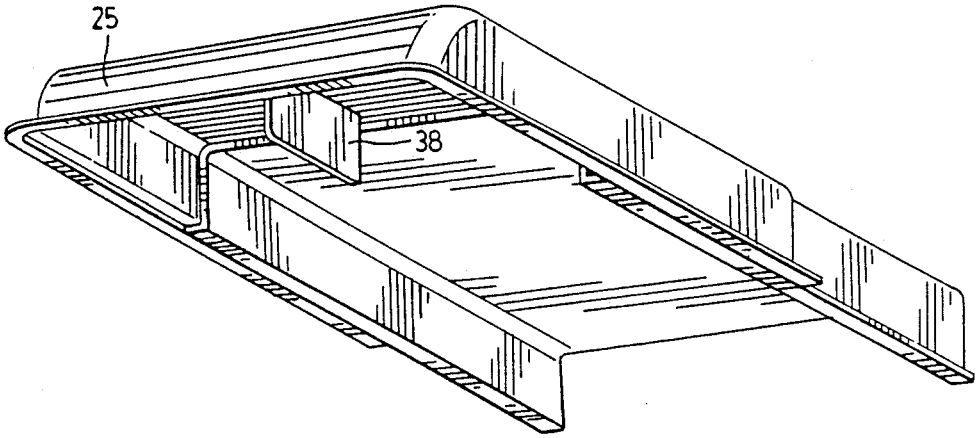
FIG. 2 is another perspective view of the deflector illustrated in FIG. 1.
Figure 3:
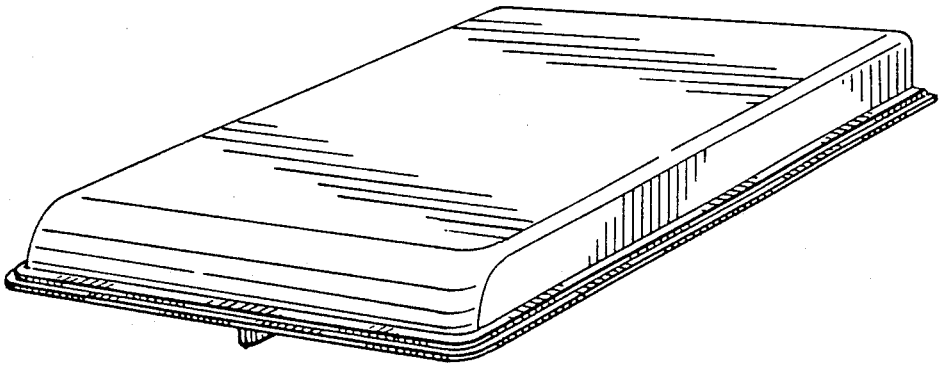
FIG. 3 is a perspective view of one portion of the deflector illustrated in FIG. 1.
Figure 7:
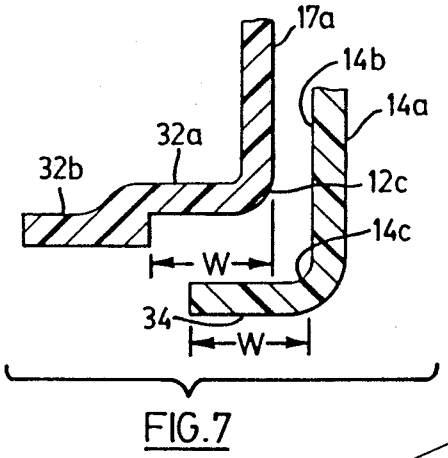
FIG. 7 is a fragmentary sectional assembly view of two portions of the deflector illustrated in FIG. 1.

Both of the first and second elements 12 and 14 have an inverted u-shaped cross section provided by a central wall panel 24, 26 and a pair of side walls 28, 30 depending therefrom. The central wall panels and side walls of each of the first and second elements form an inner face **12*a*, 14*a* and an outer face 12*b*, 14*b*, respectively (see FIG. 6). Each of the side walls 28, 30 has an outwardly projecting flange 32, 34 which serves as a base to rest against a floor surface. The flange 32 has an inner web 32*a* and on outer web 32*b* stepped downwardly therefrom. As shown in FIG. 7, the inner face 12*a* of the first element 12 terminates at the lower end of each side wall 28 in a part cylindrical corner portion 12*c* for reasons to be described. The flange 34 of the second element 14 has a width 'w' to match the width 'W' beneath the inner web 32*a*. A corner portion 14*c* joins the outer face 14*b* with the inner web 32*a*. The radius of the corner portion 14*c* substantially equals inner radius of the part-cylindrical corner portion 12*c* so that a substantially close fit is established between the first and second elements in this region. In addition, the lower web 32*b* has a lower surface 32*c* and the flange 34 has a lower surface 34*a* which lie in a common plane so that a close fit is established between the floor, the first element 12 and the second element 14. As seen in FIGS. 1 and 2 the flange 32 continues toward the inlet end 20 and along a rear wall panel 25 depending from the central wall panel 24 and joined with the side walls 28**.

The first and second elements 12 and 14 are also dimensioned so that, once telescopingly engaged, a close fit is formed between the outer face **14*b* of the second element and the inner face 12*a*** of the first element.

Projecting downwardly from the inner surface of the central wall panel 24 of the first element 12 is an anchor wall 38 (best seen in FIGS. 2 and 4) which is shaped to pass between the pair of vanes 16*a* in the vent 16. The anchor wall 38 is provided to inhibit release of the deflector from the vent 16 if inadvertently struck by a foot or some other object.

The first and second elements 12, 14 may be formed from injected plastics or some other convenient material.

To use the deflector 10, the first and second elements 12 and 14 are assembled as shown in the figures. The distance between the outlet and inlet ends 20, 22 is selected as desired by telescoping the elements inwardly or outwardly as the case may be. The deflector 10 is then placed on the floor with the flanges 32, 34 of the first and second elements establishing a substantially close fit with the floor to define a channel through which air exiting the vent 16 will be deflected to the outlet end 22. The anchor wall 38 is inserted between two vanes 16*a*. Thereafter, the location of the furniture may be changed to suit changes in style while the deflector 10 may conveniently be adjusted for length once again.

It can thus be seen that the floor can be used to form the air duct with the deflector 10 in a manner which offers a simplistic inexpensive design.

While discussion herein above has been restricted to use of the device with a floor vent, it is to be understood that the device is equally usable with a wall or other type vent. If desired, magnets may be provided at each edge of the inlet end of the device to enhance the coupling of the device with the vent. In addition, other coupling mechanisms such as screw fasteners and the like may be provided to maintain the telescoping engagement of the elements when in use on the floor vent as shown herein above or with a wall vent.

Figure 8:
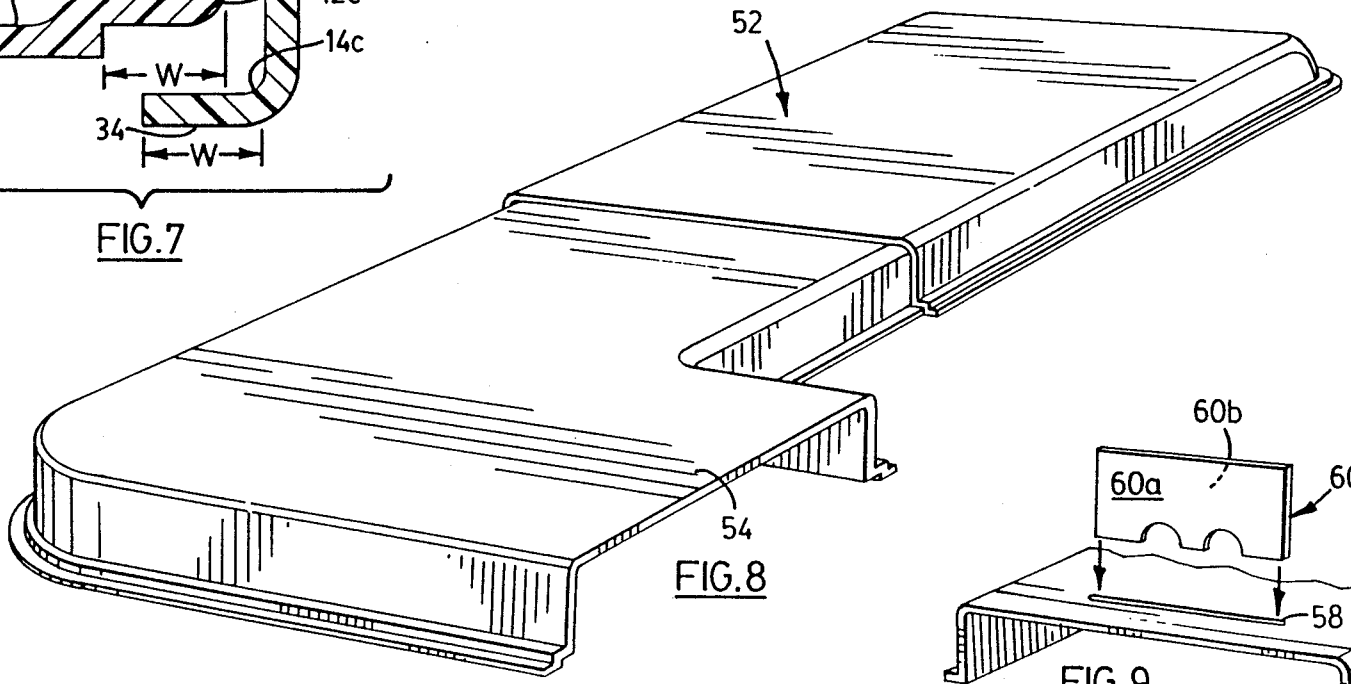
FIG. 8 is a perspective view of an alternative deflector.

In an alternative embodiment as illustrated in FIG. 8, a deflector 52 is provided wherein the second element 54 has a ninety degree bend thereby permitting the air exiting from a floor vent, for example, to be directed around an obstacle or redirected to a more appropriate location. If desired, the bend may be at a different angle as may be desired, for example forty five and sixty degree angles.

It will of course understood that the ninety degree bend may be provided on the first element 52 rather than on the second element 54, if desired.

Figure 9:
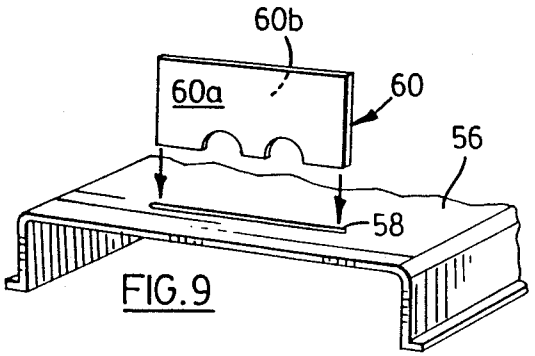
FIG. 9 is a fragmentary perspective view of yet another deflector.

In yet another embodiment as illustrated in FIG. 9, the second element 56 is provided with a slot 58 extending across the width of the outlet end. The slot 58 receives a card 60 which is impregnated with a deodorizer compound. The card 60 is further provided with two passages 62 to allow the air more evenly to flow across the inner regions of the surfaces 60*a*, 60*b* of the card and thereby to be freshened by receiving deodorizer therefrom. If desired, the passages 64 may be formed by twisting flaps cut into the bottom edge thereof, thereby forming vanes further to increase the surface area of the card and increase the amount of deodorizer that is transferred to the air. If desired, the card may be fastened to the duct in different ways, for example to the inner face of the transverse wall.

Figure 4:
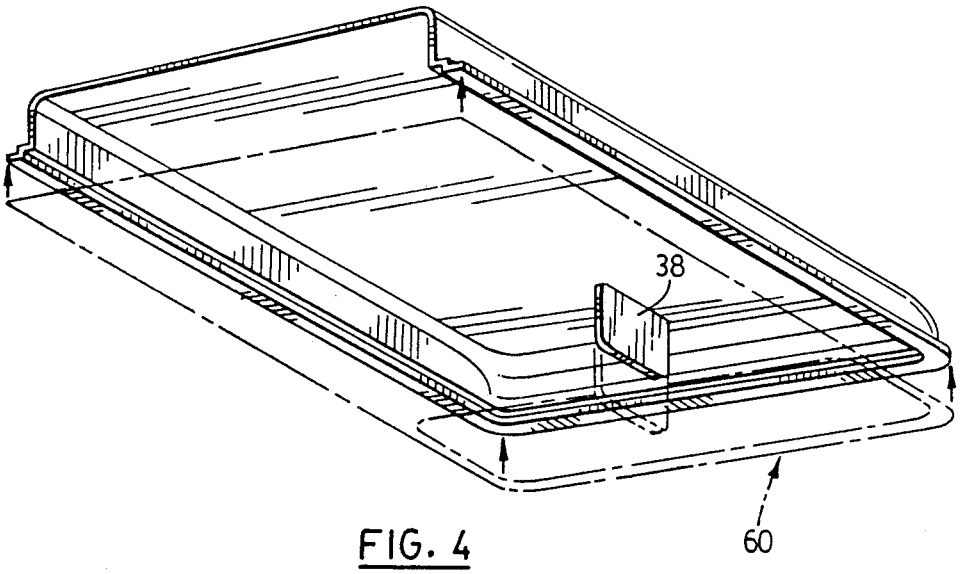
FIG. 4 is a another perspective view of the portion illustrated in FIG. 3.
Figure 5:
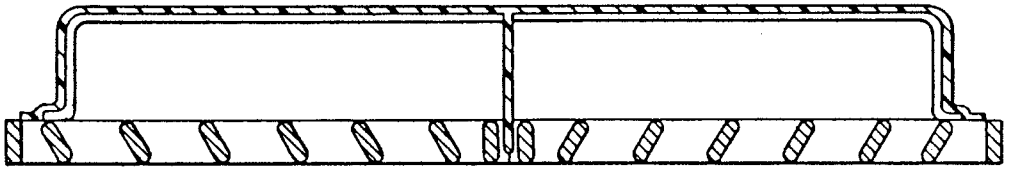
FIG. 5 is a sectional view of the deflector of FIG. 1 in an operative configuration.
Figure 6:
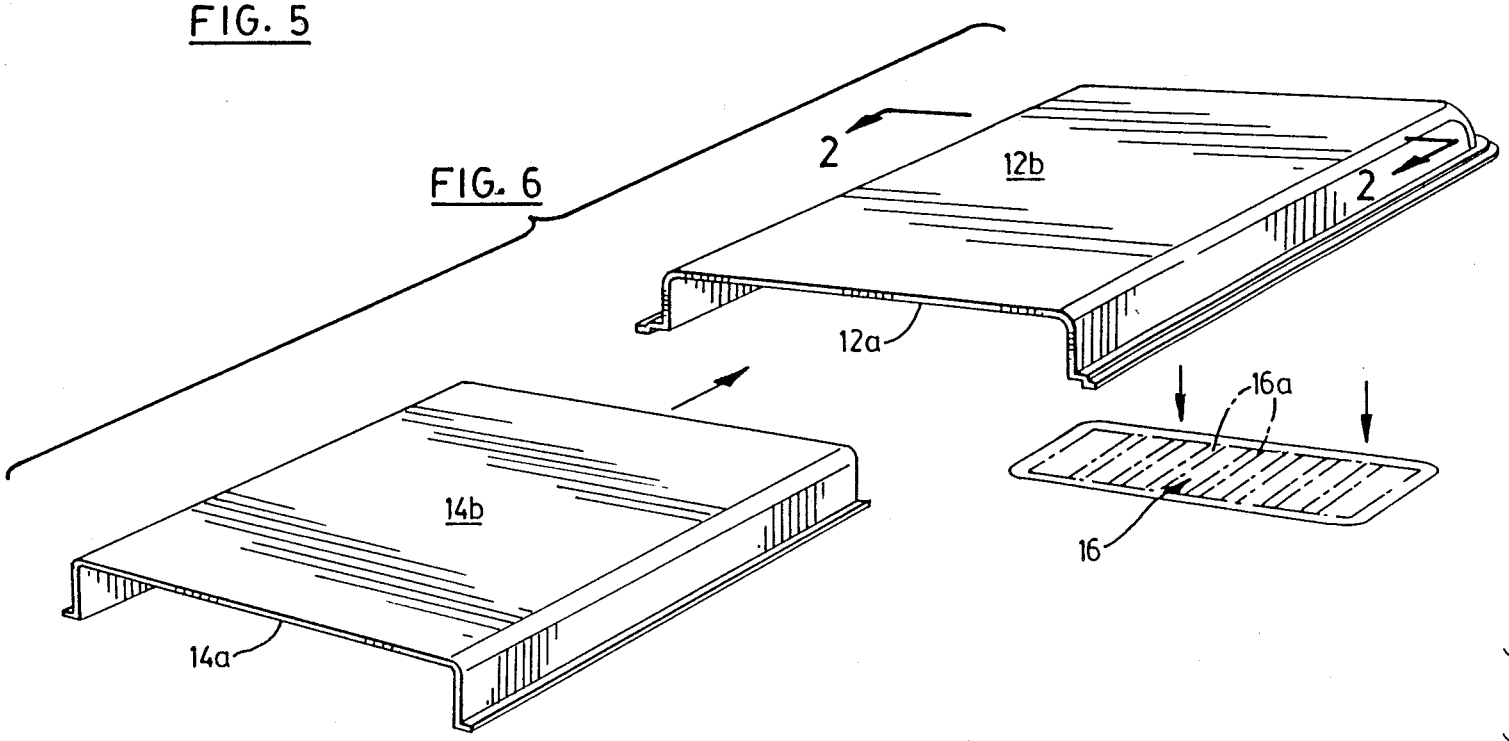
FIG. 6 is an assembly view of the deflector illustrated in FIG. 1.

If desired, the open bottom of the first and second elements 12, 14 may be closed with a suitably dimensioned panel such as that illustrated in dashed lines in FIG. 4 at 60. The perimeter of such a panel may be given an adhesive layer to attach the panel and the element together. Of course, other forms of fasteners may also be used here.

It will become readily apparent that the term 'close fit' used hereinabove (with reference to the contact between the first and second elements and the floor surface) is a relative term and will depend to a great extent on the contour and surface texture of the floor. A carpeted floor, for example, may not provide the same close fit as may be obtained on a smooth floor. However, the term 'close fit' is intended to cover the type of fit between the first and second elements and the floor in both cases. The term 'close fit' is thus intended to mean one which is sufficient to establish an air duct between the first and second elements and the floor surface wherein a measurable portion of air is transferred from the inlet end to the outlet end. Small discontinuities that may be formed between the flanges and the floor and thus result in an air loss along the duct are included in the term.

We claim:

1. An air deflector for deflecting air exiting from a residential floor vent to a location remote therefrom, comprising:

a first element having an inverted u-shaped cross section formed by a central wall panel and a pair of side walls depending from opposite longitudinal edges thereof; an end wall pane depending from said central wall panel and joining said side walls to form an inlet end;

a second element having an inverted u-shaped cross section formed from a central wall and a pair of side walls depending from opposite longitudinal edges thereof, said second element being dimensioned to engage in telescoping fashion with said first element with said central walls in abutment so that one end of said second element extends beyond said first element to form an outlet end;

the side and end walls of said first element terminate at a first flange, a portion of which is arranged to lie flat on a floor surface surrounding said floor vent; said portion extending the perimeter of said first element; each of the side walls of said second element terminate at a second flange which is arranged to lie flat against said floor surface; said second flange being arranged to be nested with said first flange when said first and second elements are telescopingly engaged, said first and second flanges constituting means to minimize air loss between said flanges and said floor surface; each of the first flanges has an inner web, said portion is an outer web which is stepped from said inner web toward said floor surface; said second flange being dimensioned to lie in nested relationship with said inner and outer webs.

2. An air deflector as defined in claim 1 wherein the second element has a pair of portions at an angle relative to one another to form a bend in said duct to permit air exiting from the floor vent to be directed around an obstacle.

3. An air deflector as defined in claim 1 further comprising a means for deodorizing air emerging form the outlet end including carrying means for carrying a deodorizing compound, retention means for retaining said carrying means at one location in the duct.

4. An air deflector as defined in claim 3 wherein said carrying means includes a card, the retaining means includes a slot near the outlet end of the duct though which the card is passed to extend into the duct.

5. An air deflector as defined in claim 1 further comprising an anchor wall portion depending from the central wall of said first element to be received between a pair of adjacent vanes in said vent to inhibit inadvertent movement of the deflector relative thereto.

6. An air deflector as defined in claim 1 further comprising a panel for interposition between said floor surface and said distal edges.

* * * * *